US006943309B2

(12) United States Patent
Huang

(10) Patent No.: US 6,943,309 B2
(45) Date of Patent: Sep. 13, 2005

(54) TWO-POSITION THREE-WIRE SWITCH

(75) Inventor: Huadao Huang, Room 501, Building 10, No. 137, Goldengrain Garden Shuanglong Road, Xialupu, Wenzhou City, Zhejiang Province (CN), 325603

(73) Assignee: Huadao Huang, Wenzhou (CN)

( * ) Notice: Subject to any disclaimer, the term of this patent is extended or adjusted under 35 U.S.C. 154(b) by 0 days.

(21) Appl. No.: 10/952,771

(22) Filed: Sep. 30, 2004

(65) Prior Publication Data

US 2005/0067269 A1 Mar. 31, 2005

(30) Foreign Application Priority Data

Sep. 30, 2003 (CN) ..... 03280095 U

(51) Int. Cl.[7] ..... H01H 1/64; H01H 1/66
(52) U.S. Cl. ..... 200/329; 200/333; 200/293
(58) Field of Search ..... 200/293, 329, 200/339, 333, 297, 296

(56) References Cited

U.S. PATENT DOCUMENTS 4,672,229 A * 6/1987 Skarman et al. ..... 307/115
5,384,441 A * 1/1995 Balaban et al. ..... 200/339
5,500,498 A * 3/1996 Kurek et al. ..... 200/556
6,392,170 B1 * 5/2002 Wechsler ..... 200/43.21
6,534,734 B2 * 3/2003 Davis ..... 200/331
6,657,144 B2 * 12/2003 Savicki et al. ..... 200/296

* cited by examiner

*Primary Examiner*—Richard K. Lee
(74) *Attorney, Agent, or Firm*—Birch, Stewart, Kolasch & Birch, LLP

(57) ABSTRACT

The present invention disclosures a two-position three-wire switch comprising a shell and two three-wire switches located in the shell. Each three-wire is composed of a pair of static contactors, a U-moving contactor, a common carriage, a middle separator plate and a toggle lever which are provided in the shell; said static contactor and common carriage are fixed at the bottom of shell; a pair of static contactors is provided on both sides of common carriage; a V-sustainer is provided at each end of said common carriage; U-moving contactor is provided located on the V-sustainer and two contacts on the outside of U-moving contactor can be connected or disconnected with the contact on a pair of static contactors; a spring is provided in U-channel of said U-moving contactor; a middle separator plate is covered over said static contactor, moving contactor and fixing carriage; said toggle lever, passing through the cover of the shell, and middle separator place, is connected with the spring in U-channel of the moving contactor.

4 Claims, 9 Drawing Sheets

TWO-POSITION THREE-WIRE SWITCH

This Nonprovisional application claims priority under 35 U.S.C. § 119(a) on Patent Application No(s). 03280095.9 filed in China on Sep. 30, 2003, the entire contents of which are hereby incorporated by reference.

FIELD OF THE INVENTION

The present invention relates to a three-wire switch.

DESCRIPTION OF THE RELATED ART

There is a variety of switch, the simplest and most common form of which is a two-wire switch, as shown in FIG. 1, in which two-wire switch $K_1$ is in series connection with a lamp L being controlled and then in parallel connection with both ends of a power supply to control the lamp L by means of closing or disconnecting $K_1$.

Yet, with continuous growing of people's material living standard, their household appliances are doubled and redoubled, so that people generally needs a switch which can control the same electric appliance at two places, for example, when people is walking on the second floor he wishes to turn on the lamp of that floor, while when walking at the third or first floor he wants to turn off the lamp of the second floor. If a conventional two-wire switch is applied, it is inconvenient to do this operation, in addition to add other logic control device into its electric circuit. In this way, it is not only complex and troublesome, but also easy to be broken down and difficult to repair and high in cost.

Besides, if people need to control two controlled objects at the same place, such as two lamps, it is generally needed to install two two-wire switches, everyone controls a lamp, resulting in unbeautiful viewing from outward appearance and very high cost. However, if a switch is discovered which can control two controlled objects simultaneously by means of one switch, how pretty it is!

Through continuously testing, the designers discovered to control the same controlled object at different places is easy to realize if two three-wire switches are connected into circuit, and to control two controlled objects at the same place is also easy to realize if a three-wire switch is connected into wiring.

SUMMARY OF THE INVENTION

In view of the above-mentioned reasons, the primary object of the present invention is to provide a three-wire switch.

Another object of the present invention is to provide a two-position three-wire switch, which is composed of two three-wire switches integrated and compactly, with its function being the same as two one-position three-wire switches.

In order to realize the above-mentioned objects, the present invention takes following technical project: a two-position three-wire switch is composed of a shell and two three-wire switches located in said shell; each three-wire switch is composed of a pair of static contactors, a U-moving contactor, a common carriage, a middle separator plate and a toggle lever, which are located in said shell;

said static contactors and a common carriage are fixed at the bottom of the shell; a pair of, said static contactor are provided at both sides of the common carriage;

a contact is provided on each static contactor, two contacts are provided on a pair of static contactors, the two contacts are located in opposite direction;

a V-sustainer is provided at each end of said common carriage; said U-moving contactor is provide on said V-sustainer, two contacts on the outside of both sidewalls of U-moving contactor can be connected or disconnected with the contacts on a pair of static contactors;

a spring is provided in the U-channel of said U-moving contactor;

said middle separator plate is covered over said static contactors, moving contactor and common carriage; on the middle separator plate openings are provided at the place corresponding with said moving contactor; said toggle lever is past through said opening and connected with the spring located in U-channel of said moving contactor.

The toggle lever outcrops from said opening which is provided in the shell.

In the concrete embodiment of the present invention.

Said shell includes a cover and bottom case, in said bottom case several ribs for clipping of static contactors and common carriage are provided in accordance with the shape of static contactors and common carriage to be held.

On all sides of said cover several small apertures are provided.

On all sides said bottom case, several sloping bosses being able to be clipped in said apertures are provided at the places corresponding with said apertures.

Between said cover and middle separator plate a metallic earthing frame is provided; in said metallic earthing frame openings are provided at the places corresponding with said moving contactors.

Between said toggle lever and metallic earthing frame a rubber washer is provided.

The present invention is compact in structure, easy to use and has a wide field of application. In order to control two electric appliances to be controlled at an identical place or to control the same electric appliances at different places, it is easy to realize to use one or two three-wire switches.

DESCRIPTION OF THE PREFERRED EMBODIMENTS

Figure 2:
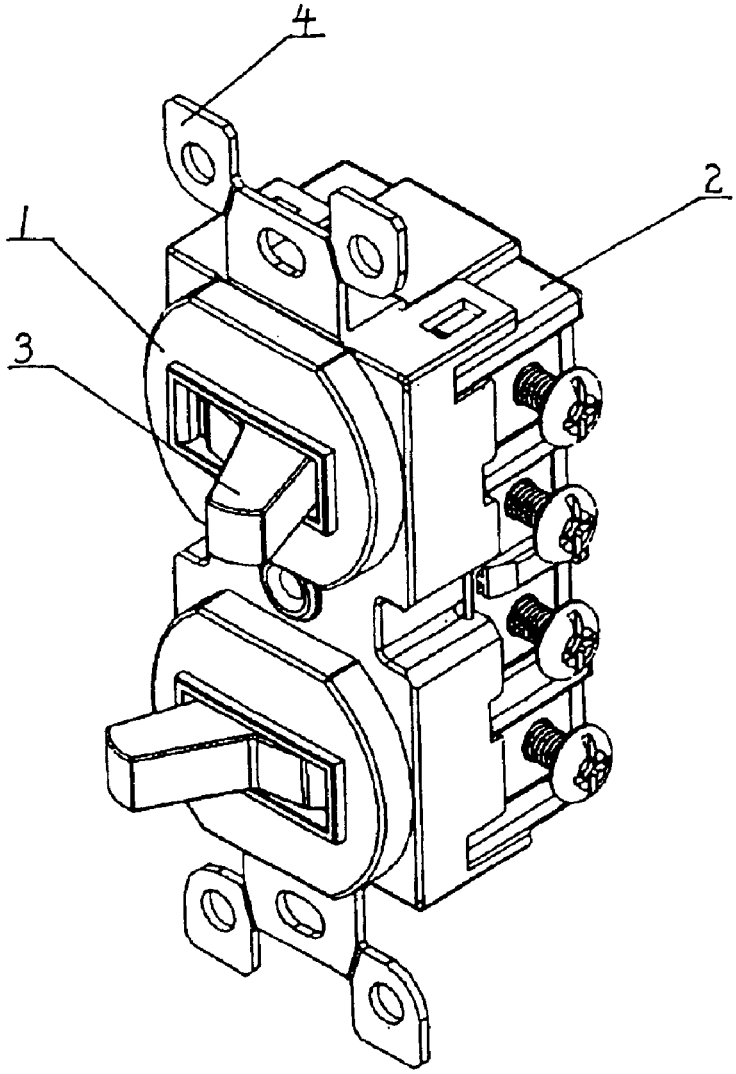
FIG. 2 is a special skeleton view of the present invention.
Figure 3:
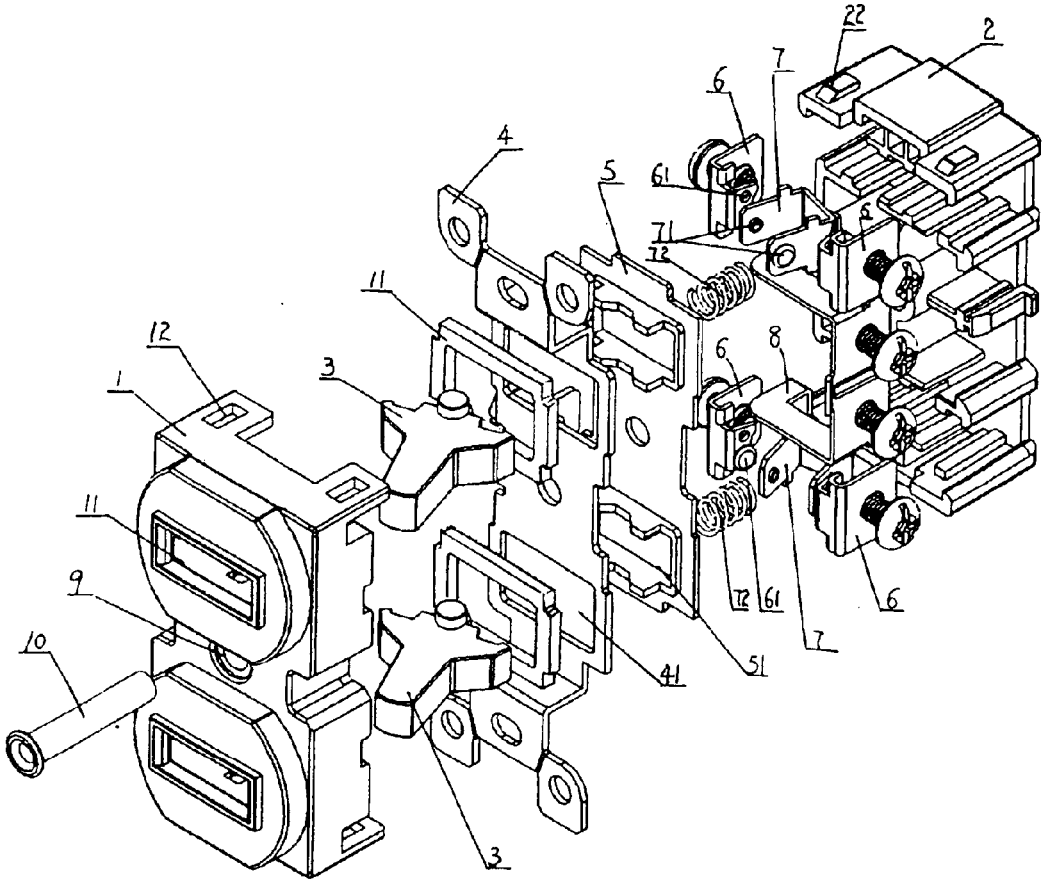
FIG. 3 is an exploded view of the present invention.

As shown in FIGS. 2 and 3, the two-position three-wire switch of this present invention is primarily composed of a cover 1, a bottom case 2, two toggle lever 3 mounted on the cover 1, a metallic earthing frame 4 and a middle separator plate 5 which are mounted between the cover 1 and bottom case 2, two pairs of static contactors 6, two moving contactors 7 and a common carriage 8 which are fixed in the bottom case 2.

Figure 4:
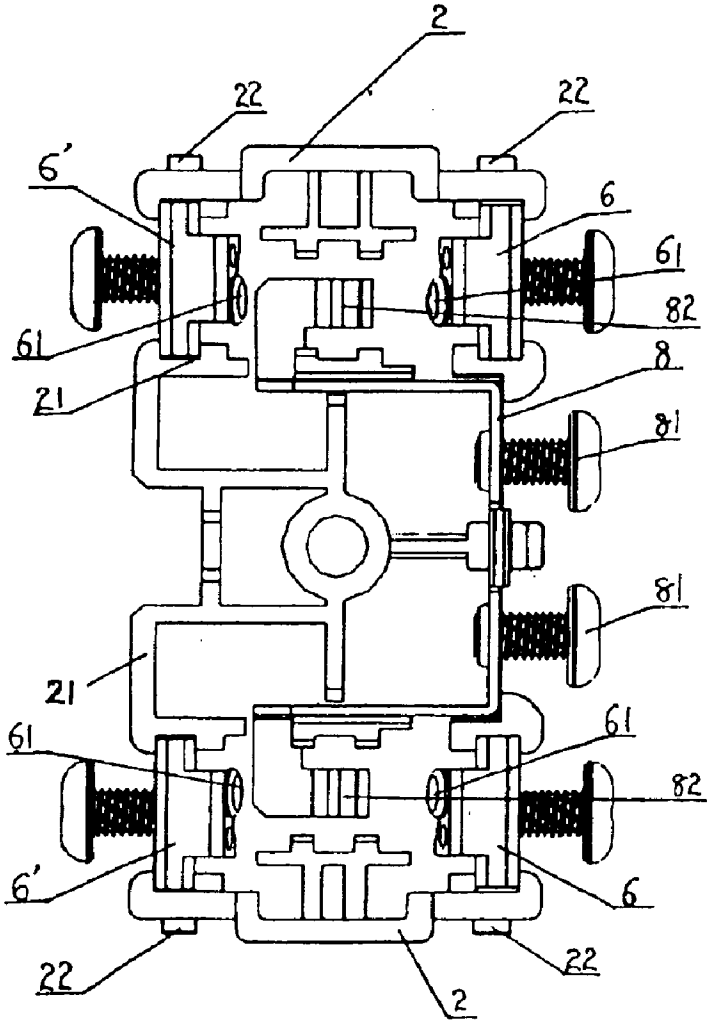
FIG. 4 is an explosive view of the bottom case of the present invention.

As shown in FIG. 4, in said bottom case 2 there exist many longitudinal and lateral ribs 21 which are made in accordance with the shape of the static contactor 6 and common carriage 8 to be held. Said static contactor 6 and common carriage 8 are clipped in the bottom case 2 by these ribs 21. As shown in FIG. 4, two pairs of static contactor 6 are held at four corners of the bottom case 2, the common carriage 8 is held at one said of the bottom case 2, and on the outside of bottom case 2 two screws connecting with common carriage 8 lead out two common supporting ends 81.

Figure 5:
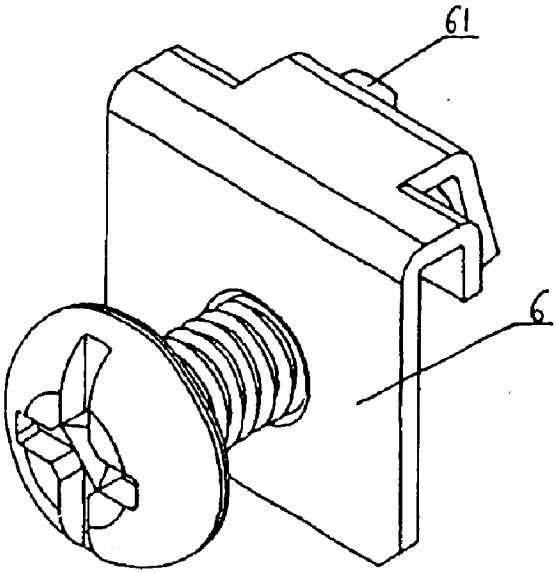
FIG. 5 is a perspective view of the static contactor of the present invention.

FIG. 5 shows the static contactor 6, As shown in FIG. 5, a contact 61 is provided on static contactor 6. The contactors 61 of two pairs of static contactor 6 held in bottom case 2 are pairwise opposite, as shown in FIG. 4.

Figure 6:
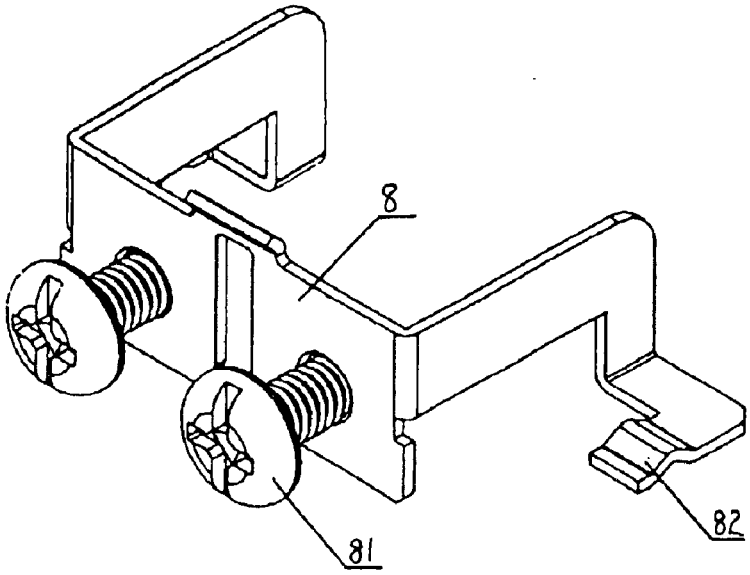
FIG. 6 is a perspective view of the common carriage of the present invention.
Figure 7:
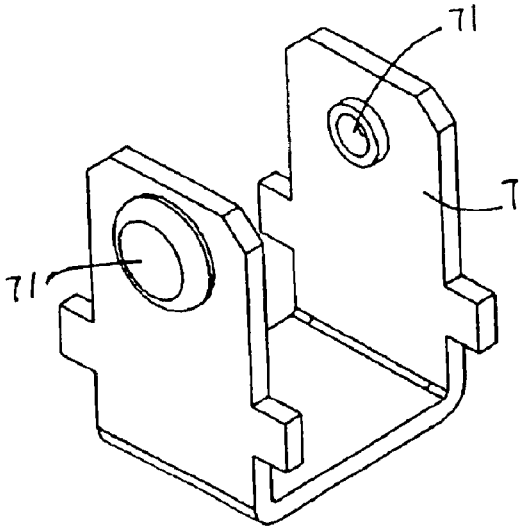
FIG. 7 is a perspective view of the moving contactor of the present invention.
Figure 9:
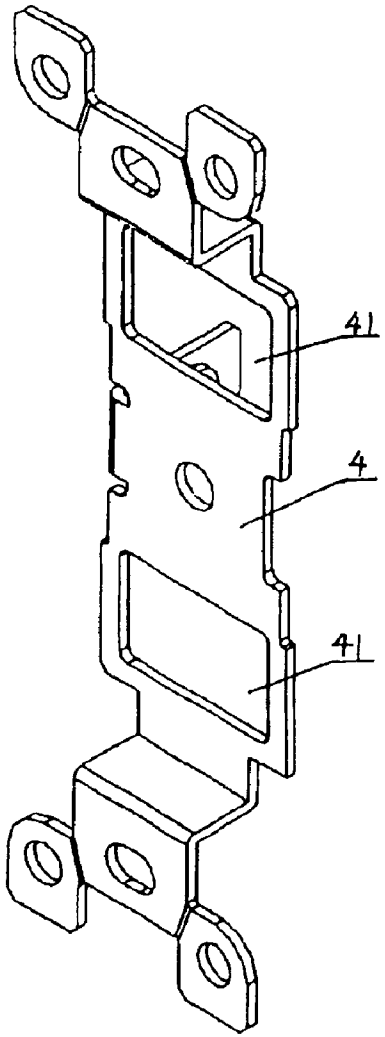
FIG. 9 is a perspective view of the metallic earthing frame of the present invention.

FIG. 6 shows the structure of the common carriage 8. As shown in FIG. 6, a V-sustainer 82 is provided on both ends of common carriage 8. As shown in FIG. 7, said U-moving contactor 7 is held on the V-sustainer 82 at both ends of common carriage 8. The contacts 71 on the outside of both sidewalls of moving contactor 7 are in correspondence with the contact 61 on static contactor 6.

Figure 8:
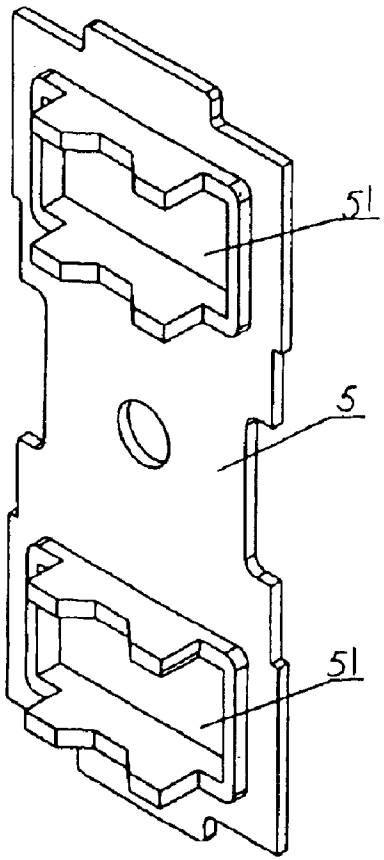
FIG. 8 is a perspective view of the middle separator plate of the present invention.

The middle separator plate 5 and metallic earthing frame 4 are mounted between cover 1 and bottom case 2, which are used to cover the static contactor 6, moving contactor 7 and common carriage 8 and press them into bottom case 2. As shown in FIG. 8,9, openings 51, 41 are provide on the middle separator plate 5 and metallic earthing frame 4 at the place corresponding with moving contactor 7. The toggle levers 3 passing through opening 51, 41 are contact with the spring 72 placed in U-channel of moving contactor 7, as shown in FIG. 3.

To make the toggle levers 3 passing through cover 1, as shown in FIG. 3, openings 11 are also provided in cover 1.

Figure 10:
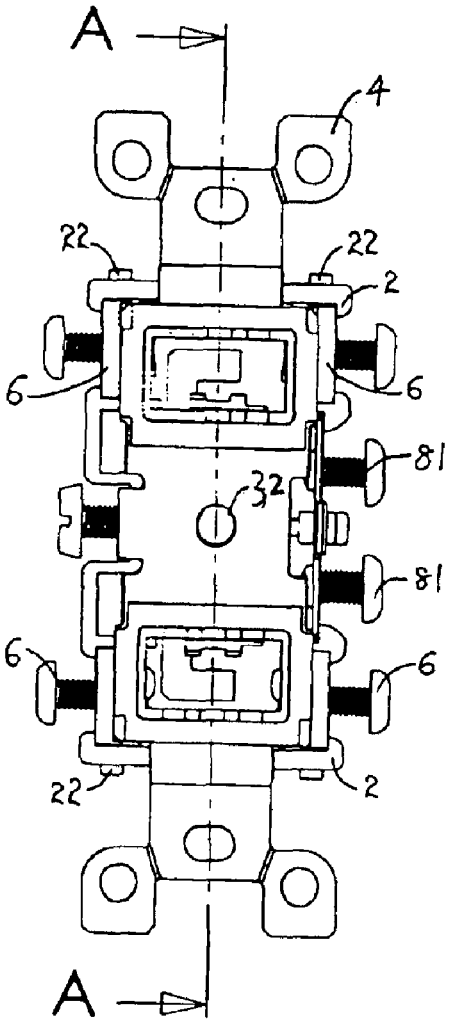
FIG. 10 is a vertical view of the present invention without the cover.
Figure 11:
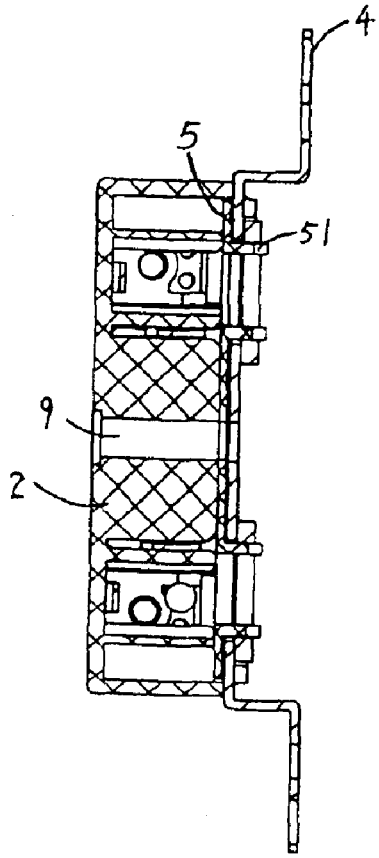
FIG. 11 is a sectional view taken along A—A in FIG. 10.
Figure 12:
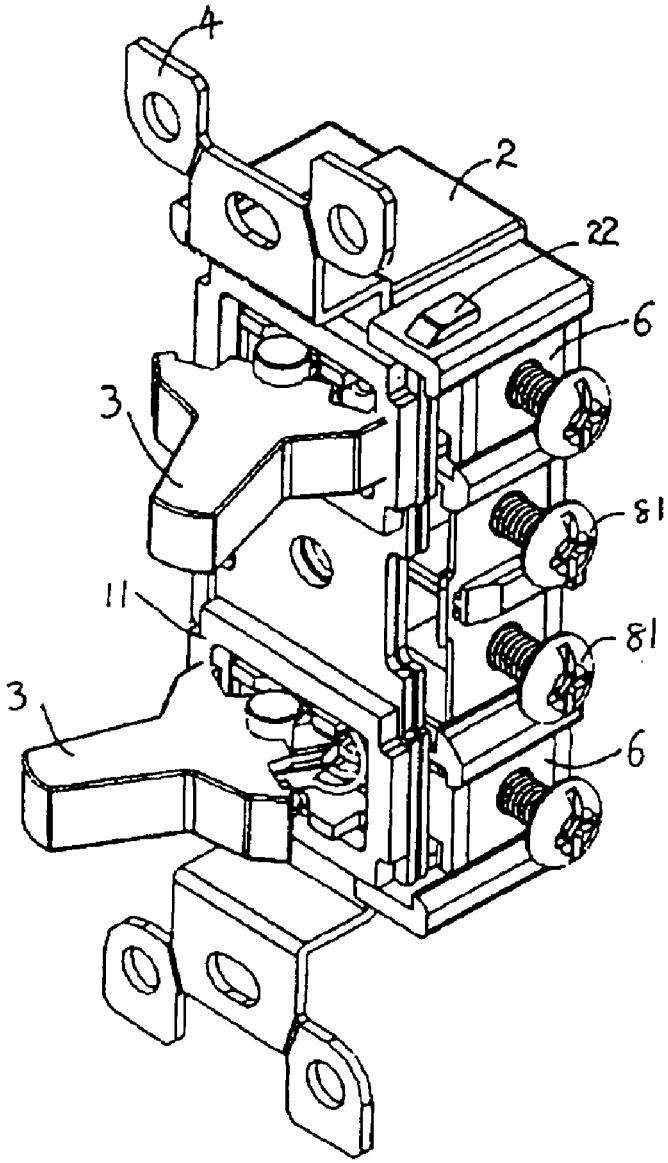
FIG. 12 is a perspective view of the present invention without the cover.

As shown in FIG. 3, during mounting, first, place four static contactor 6 and the common carriage 8 into bottom case 2, then place the U-moving contactor 7 on V-sustainer 82 located at both ends of common carriage 8, so as to make the moving contactor 7 being able to vacillate to the left and right on V-sustainer 82, and the contact 71 on both outsides of U-moving contactor 7 being able to connect or disconnect with the contact 61 on both sides of static contactor 6; thereafter, place a spring 72 into U-channel of moving contactor 7; put the middle separator plate 5 and metallic earthing frame 4 on, as shown in FIGS. 10 and 11; pass one end of toggle lever 3 through middle separator plate 5 and metallic earthing frame 4, and touch it with the spring 72 in U-channel of moving contactor 7, as shown in FIG. 12; and then make the other end of lever 3 passing through the opening 11 of cover 1, in order to fix the two-position three-wire switch being assembled, provide many small apertures 12 on all sides of cover 1, correspondingly, provide many sloping bosses 22 on all sides of bottom case 2, having been assembled, insert the sloping boss 22 of bottom case 2 into aperture 12 and force the cover 1 and bottom case 2 to be clipped together, as shown in FIGS. 2 and 3.

In order to fasten the assembled switch together, this is a hole running through the switch from top to bottom, through which corresponding rivet or bolt 10 is past to fasten all assemblies of the switch together.

Figure 13:
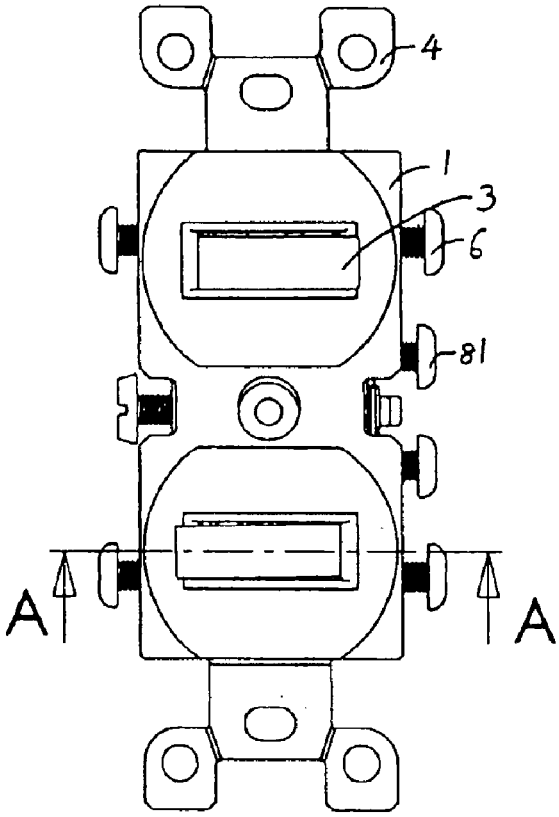
FIGS. 13 and 14 show the principle of on-off mechanism of the present invention.
Figure 14:
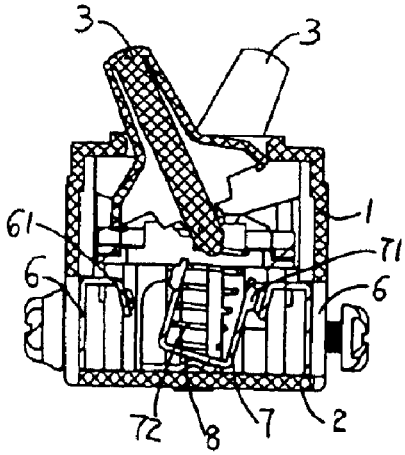

As shown in FIGS. 13 and 14, because one end of the lever 3 is pressed against the spring 72 located in U-channel of moving contactor 7, the lever 3 will bring the moving contactor 7 to vacillate to the left and right with a certain extent through spring 72 when toggling the lever 3, so that the common supporting end 81 will connect and disconnect with the contact 61 of static contactor 6 on both sides, thus to realize the function of said three-wire switch.

To reduce the hard friction between toggle lever 3 and metallic earthing frame 4, as shown in FIG. 3, place a rubber washer 11 between lever 3 and earthing frame 4.

Figure 1:
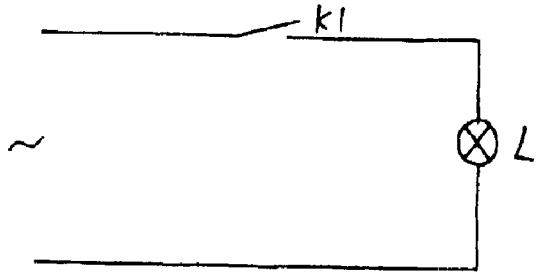
FIG. 1 is a functional diagram of a conventional two-wire switch.
Figure 15:
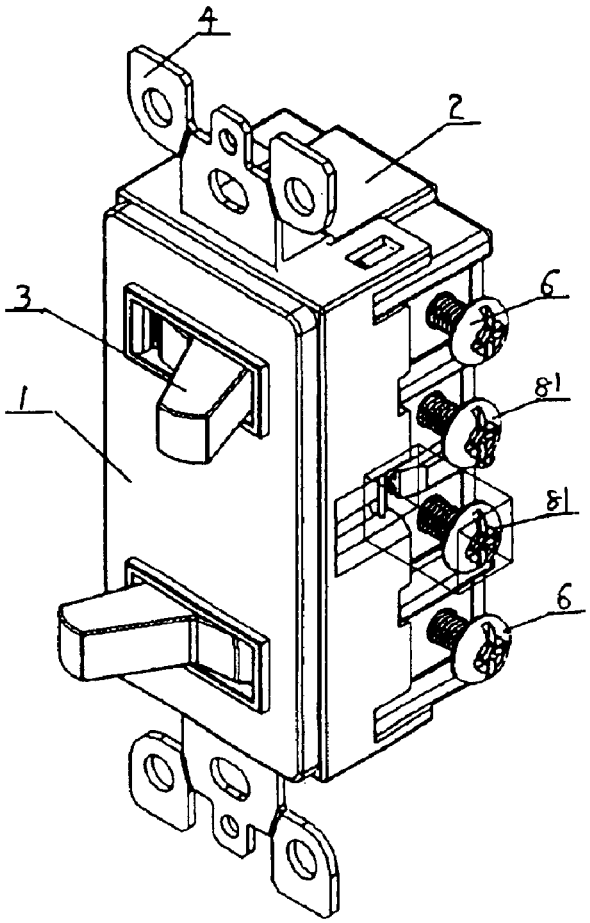
FIG. 15 is a perspective view of another configuration of the present invention.

Similarly, the present invention can also design a one-position three-wire switch, three-position three-wire switch or multi-position three-wire switch in accordance with the need for customer. Otherwise, the cover 1 may be designed into standard type (FIG. 1), decorative type (FIG. 15), or other types according to the like of the customer.

Figure 16:
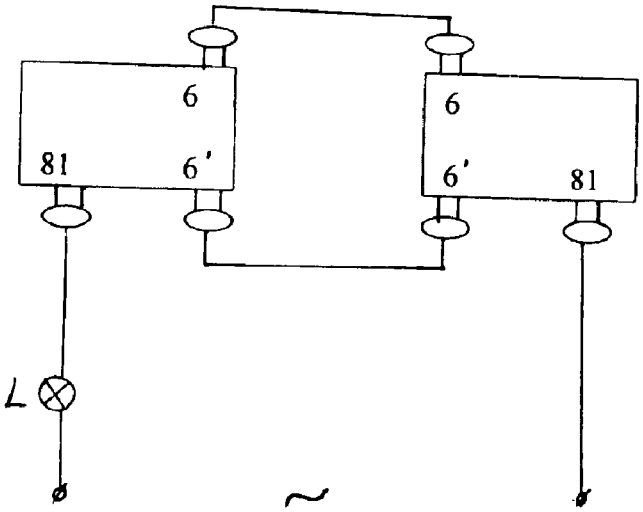
FIG. 16 is a functional diagram of the present invention.

It will be illustrated below that how to use two one-position three-wire switches (or two two-position three-wire switch) to control the same electric appliance being controlled at different place. First, according to FIG. 16, connect the two three-wire switches together, then connect with the controlled object L. As shown in the figure, when toggling the lever 3 of the first three-wire switch, to make the common supporting end 81 conducting with static contactor 6, the controlled object L is conducting, if the second three-wire common supporting end 81 is just conducting with static contactor 6 also; If at that time, want to turn off the controlled object L at different places, it is needed to toggle the lever 3 of second three-wise switch only, to disconnect the common supporting end 81 with static contactor 6 and connect with static contactor 6', so it is very simple.

The above description is only the better embodiments of this present invention, the claims of which is not limited in it. Any equivalent based on the technical project of this present invention belongs to the claims of this present invention.

What is claimed is:

1. A two-position three-wire switch including a shell and two three-wire switch within said shell, characterized in:

each three-wire switch is composed of a pair of static contactors, a U-moving contactor, a common carriage, a middle separator plate and a toggle lever, which are located in said shell;

said static contactors and a common carriage are fixed at the bottom of said shell; A pair of, said static contactor are provided at both sides of the common carriage;

a contact is provided on each static contactor, two contacts are provided on a pair of static contactors, two contacts are located in opposite directions;

a V-sustainer is provided at each end of said common carriage; said U-moving contactor is provide on said V-sustainer, two contacts on the outside of both sidewalls of U-moving contactor can be connected or disconnected with the contacts on a pair of static contactors;

a spring is provided in the U-channel of said U-moving contactor;

said middle separator plate is covered over said static contactors, moving contactor and fixing carriage; on the middle separator plate openings are provided at the place corresponding with said moving contactor; said toggle lever is past through said opening and connected with the spring located in U-channel of said moving contactor;

an opening is provided on said shell, from which aid toggle lever emerges.

2. A two-position three-wire switch according to claim 1, characterized in: said shell includes a cover and a bottom case, several ribs for holding the static contactor and common carriage are provided in said bottom case, the shape of ribs are in accordance with the static contactors and common carriage to be held;

on all sides of said cover, several apertures are provided;

on all sides of said bottom case, several sloping bosses used to be jammed in said apertures are provided at the place corresponding to said apertures.

3. A two-position three-wire switch according to claim 2, characterized in: a metallic earthing frame is provided between said cover and middle separator plate, on which openings are provided at the place corresponding to said moving contactor.

4. A two-position three-wire switch according to claim 3, characterized: a rubber washer is provided between said toggle lever and metallic earthing frame.

* * * * *